United States Patent [19]

Kong

[11] Patent Number: 4,489,937

[45] Date of Patent: Dec. 25, 1984

[54] SAFETY DYNA-BENDER

[76] Inventor: Cathay G. T. Kong, 181, Min-Tsu Rd., Ping-Tung City, Taiwan

[21] Appl. No.: 407,745

[22] Filed: Aug. 13, 1982

[51] Int. Cl.[3] ..... A63B 21/02

[52] U.S. Cl. ..... 272/137; 272/143; 272/142

[58] Field of Search ..... 272/137, 142, 143, 135, 272/67, 68; 124/7, 8, 9; 276/166, 167, 182, 168

[56] References Cited

U.S. PATENT DOCUMENTS

| | | | |
|---|---|---|---|
| 2,714.008 | 7/1955 | Urban | 272/137 |
| 3,396,967 | 8/1968 | Brown | 272/67 |
| 3,451,675 | 6/1969 | Burzenski | 272/137 |
| 3,552,371 | 1/1971 | Kahelin | 124/7 |
| 4,193,593 | 3/1980 | Wilson | 272/67 X |
| 4,305,582 | 12/1981 | Barton | 272/67 X |
| 4,328,964 | 5/1982 | Walls | 272/143 X |

*Primary Examiner*—Richard J. Apley
*Assistant Examiner*—William R. Browne

[57] ABSTRACT

A safety dyna-bender is disclosed having a center cord with considerable flexibility and proper length installed in the hollow section of a dyna-bender through the coupling of a pair of cup-shape positioning anchors, which are respectively disposed at each end of the handle pipes rigidly connected to the steel spring coil thereof. The arrangement of the center cord and the cup-shape positioning anchors within the structure of the dyna-bender provides a safety assurance in protecting the user against any unexpected accidents resulting from either the breaking of the steel spring coil or the sudden loose of the handle pipe of the dyna-bender during exercise.

1 Claim, 11 Drawing Figures

SAFETY DYNA-BENDER

BACKGROUND OF THE INVENTION

1. Field of the Invention

This invention relates to a safety dyna-bender, which has a center cord matched with a pair of cup-shape positioning anchors installed therein for protection against any mishaps unexpectedly occurring during bending exercise.

2. Description of the Prior Art

The structure of the conventional dyna-bender is shown in FIG. 1, which includes a steel spring coil 10 as the main component, a pair of metal handle pipes 11 and 12 separately connected to the steel spring coil 10 at both ends, a pair of hand grips 13 and 14 rigidly coupled with the handle pipes, and a pair of wrist rings 131 and 141 respectively provided at each end of the hand grips 13 and 14. The defects of the conventional dyna-bender are as follows:

(1) As the steel spring coil 10 is manufactured in mass production, minor flaws can easily be incurred in the operations of drawing and heat treatment. As a result, the internal stress and the crystal structure of the steel spring coil 10 are not formed in complete normal condition and easily subject to the harmful effect of stress concentration and over hardness. Henceforth, the steel spring coil 10 will soon become fragile and easily be broken during bending exercise (as shown in FIG. 2).

(2) The steel spring coil 10 is susceptible to external damage such as scraches, indentations, etc., caused by the machine tools during manufacturing process and handling operations, and its metal crystallization is often badly affected therefrom. Consequently, when the internal stress is concentrated at the damaged spot so as to have the metal crystal seriously impaired thereat, the steel spring coil 10 will also be broken once the application of the external force is beyond its load limit.

(3) The way of connection between the steel spring coil 10 and the handle pipes 11 and 12 is usually done by force-fully thrusting the end of the handle pipes into the open recess of the steel spring coil 10 at both ends thereof. Because of the difference of the internal diameter R of the steel spring coil 10 effected during manufacturing process, the joints formed thereof may be either too tight or in a slack condition therebetween. In such kind of states, if the connection is too tight, the jointed portion of the handle pipes 11 and 12 within the steel spring coil 10 will not be sufficiently engaged, or the contacting area thereof be a small one, or the contact thereof be even made only on some projected points by the handle pipes 11 and 12 along the inner surface of the steel spring coil 10. Therefore, the connection made between the handle pipes 11, 12 and the steel spring coil 10 is not perfect. When the steel spring coil 10 is bent in the way as shown in FIG. 3A during exercise, a friction force $F_1$ in the direction as shown by the arrow will occur at side A, while another friction force $F_2$ in the reverse direction will also take place at side B. Referring to FIG. 3B, when the applied force is reduced or completely ceased thereat, the steel spring coil 10 will recover, and another friction force $F_1'$ and $_2'$ at both sides thereof as shown by the arrows will also occur in the reverse direction to the time before as in FIG. 3A. During exercise, the repeated bending and recovering operations of the dyna-bender will naturally cause gradual wearing-away of the binding area between the steel spring coil 10 and the handle pipes 11 and 12 through the frictions mentioned above. Under such circumstance, the steel spring coil 10 may suddenly break loose with the handle pipe 11 at one end as shown in FIG. 4, imposing a very dangerous condition thereabout.

(4) As shown in FIG. 1, a pair of wrist rings 131 and 141 are respectively provided at each end of the hand grips 13 and 14 for being put around the wrist of the user during exercise in order to prevent the hands of the user from accidental fail to grasp the hand grip and cause serious condition thereat. However, due to the fact that the wrist rings 131 and 141 are movably attached thereto by tying up the ends in a knot 132, 142 therein, the wrist rings 131 and 141 are easily retracted into the hollow section of the hand grips 13 and 14 and difficult to be drawn out therefrom. Therefore, without precausionary meansures, the user often neglect the existence of the wrist rings 131 and 141 and does not use them during exercise.

SUMMARY OF THE INVENTION

It is accordingly a primary object of this invention to provide a safety dyna-bender with a flexible center cord installed therein for overcoming the foregoing defects associated with the prior-art dyna-bender.

According to this invention, this and other objects are achieved by providing a safety dyna-bender, which comprises a center cord with considerable flexibility and proper length installed within the hollow section of a conventional dyna-bender which includes a steel spring coil rigidly connected to a handle pipe at both ends, a pair of hand grips separately coupled with the handle pipes, and a wrist ring provided at each end of the hand grip; and a pair of cup-shape positioning anchors respectively disposed in the handle pipes with respect to the center cord and the wrist rings. The arrangement of the center cord and the cup-shape positioning anchors within the structure of the dyna-bender can effectively protect the user against any unexpected accidents resulting from either the breaking of the steel spring coil or the sudden loose of the handle pipe thereof during exercise.

Further characteristics and advantages of this invention will become apparent from the following descriptions of one example of a preferreed embodiment given below with reference to the accompanying drawings.

DETAILED DESCRIPTION OF THE PREFERRED EMBODIMENTS

Figure 1:
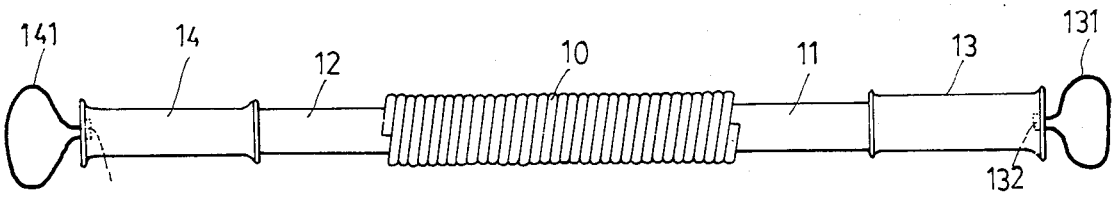
FIG. 1 PRIOR ART
FIG. 1 is a front view of the prior art dyna-bender.
Figure 2:
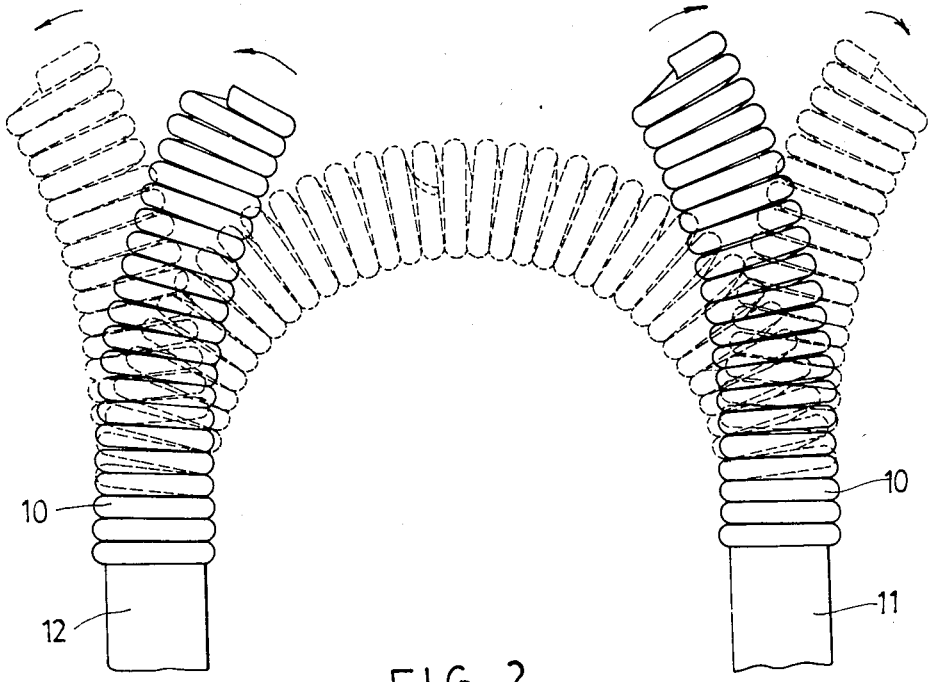
FIG. 2 PRIOR ART
FIG. 2 is a front view of the breaking condition of the steel spring coil shown in FIG. 1.
Figure 3A:
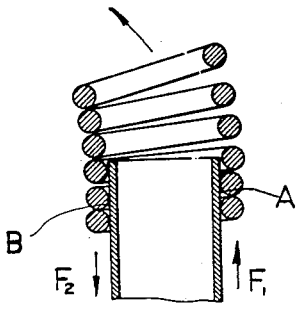
FIG. 3A PRIOR ART
FIG. 3A is a longitudinal sectional view showing the direction and area of friction at the faying surface between the steel spring coil and the handle pipe during the bending operation of the dyna-bender in FIG. 1.
Figure 3B:
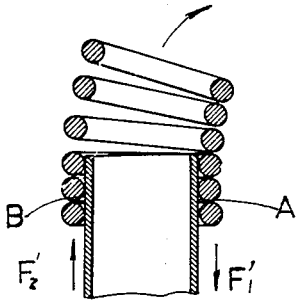
FIG. 3B is a longitudinal sectional view showing the other direction and area of friction at the faying surface between the steel spring coil and the handle pipe during the recovering condition of the duna-bender in FIG. 1 after the bending operation.
Figure 4:
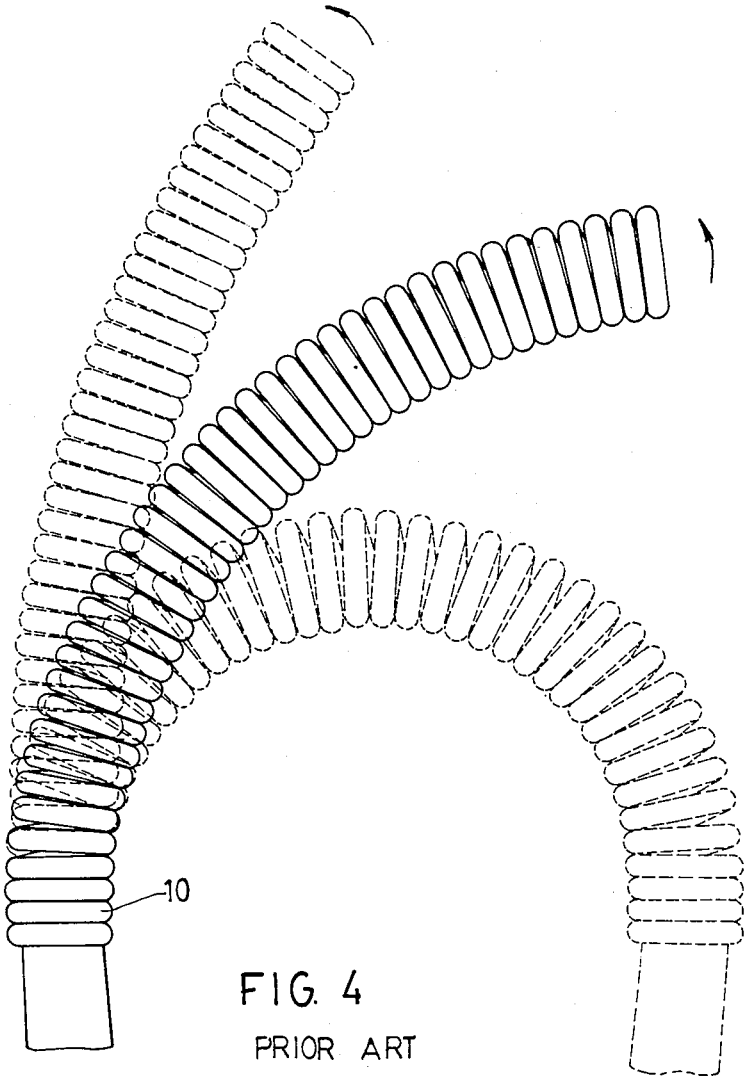
FIG. 4 PRIOR ART
FIG. 4 is a front view of the breaking loose condition of the steel spring coil at one end during exercise with the dyna-bender in FIG. 1.
Figure 5:
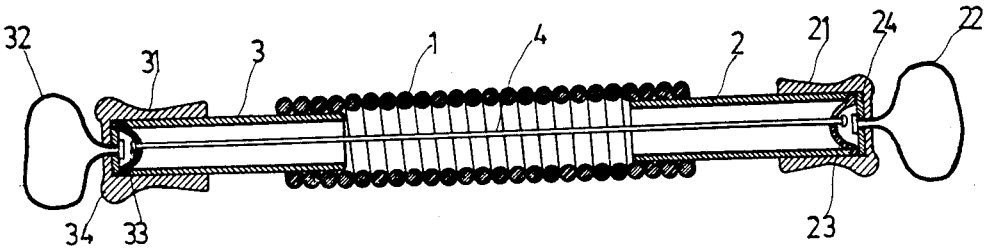
FIG. 5 is a longitudinal sectional view of a preferred embodiment of a safety dyna-bender according to this invention.

Referring to FIG. 5, a preferred embodiment of a safety dyna-bender according to this invention comprises a flexible center cord 4 installed within the structure of a conventional dyna-bender, which includes a steel spring coil 1 rigidly connected to a metal handle pipe 2 at one end and a metal handle pipe 3 at the other, a pair of hollow hand grips 21 and 31 respectively coupled with the handle pipes 2 and 3 at both outer end portions thereof, and a pair of wrist rings 22 and 32 separately provided at each end of the hand grips 21 and 31; and a pair of cup-shape positioning anchors 23 and 33 respectively disposed within each end portion of the handle pipes 2 and 3 for keeping the flexible center cord 4 in proper position therein as well as restricting the retracting movement of the wrist rings 22 and 32 thereof.

Figure 6:
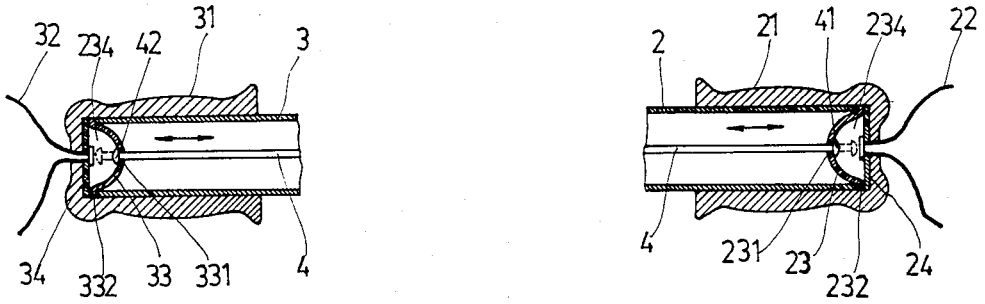
FIG. 6 is an enlarged sectional view showing the condition of a flexible center cord and a pair of cup-shape positioning anchors within the structure of the safety dyna-bender according to this invention.

As shown in FIG. 6, each of the cup-shape positioning anchors 23 and 33 has a flange collar 232, 332 integrally formed along the open edge thereof for being extrudingly secured around the sealed ends 24 and 34 of the handle pipes 2 and 3, and a central aperture 231, 331 formed therein for passing through the center core 4, which is secured thereat by a dead point 41 formed at one end and a dead point 42 formed at another for preventing the center cord 4 from breaking loose therefrom; so that, with such symmetric arrangement, the center cord 4 is retractable therein so as to meet the bending and recovering operations of the dyna-bender during exercise.

Figure 7:
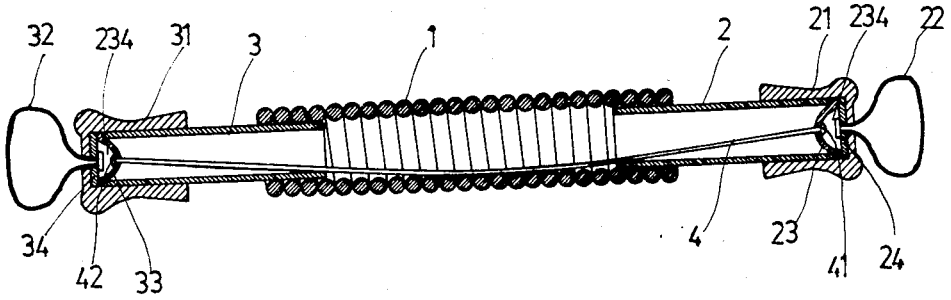
FIG. 7 is a longitudinal sectional view of another connection condition of the center cord and the cup-shape positioning anchors according to this invention.

On the other hand, if the center cord 4 is made of inflexible material such as hemp cord, both ends of the center cord 4 are preferably fastened to the cup-shape positioning anchors 23 and 33 at the center points 41 and 42 as shown in FIG. 7.

In addition to keeping the center cord 4 in proper position within the safety dyna-bender, the cup-shape positioning anchors 23 and 33 performs another function, i.e. to prevent the wrist rings 22 and 32 from retracting into the handle pipes 2 and 3 because each space 234 separately defined by the disposition of the cup-shape positioning anchors 23 and 33 against the sealed ends 24 and 34 thereof is inadequate for accepting the retraction of the wrist rings 22 and 32 therein.

Figure 8:
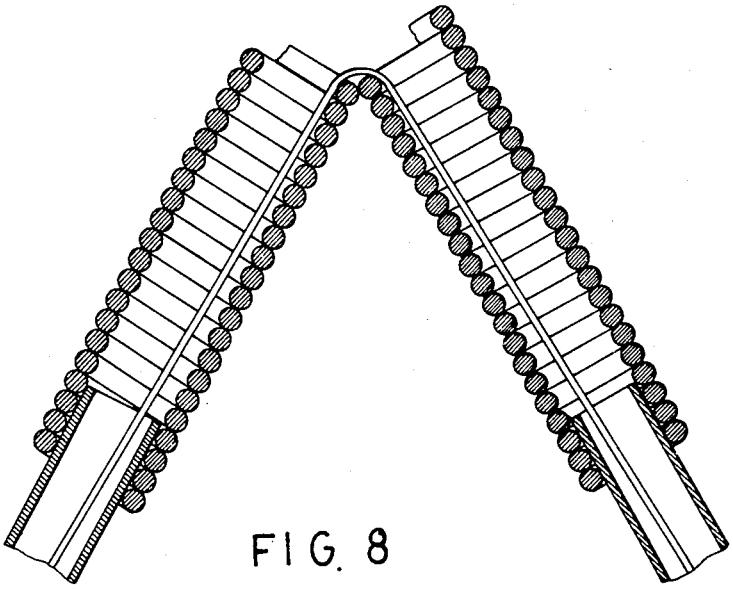
FIG. 8 is a sectional view of the unexpected breaking condition of the steel spring coil of the safety dyna-bender in FIG. 5 or 7.
Figure 9:
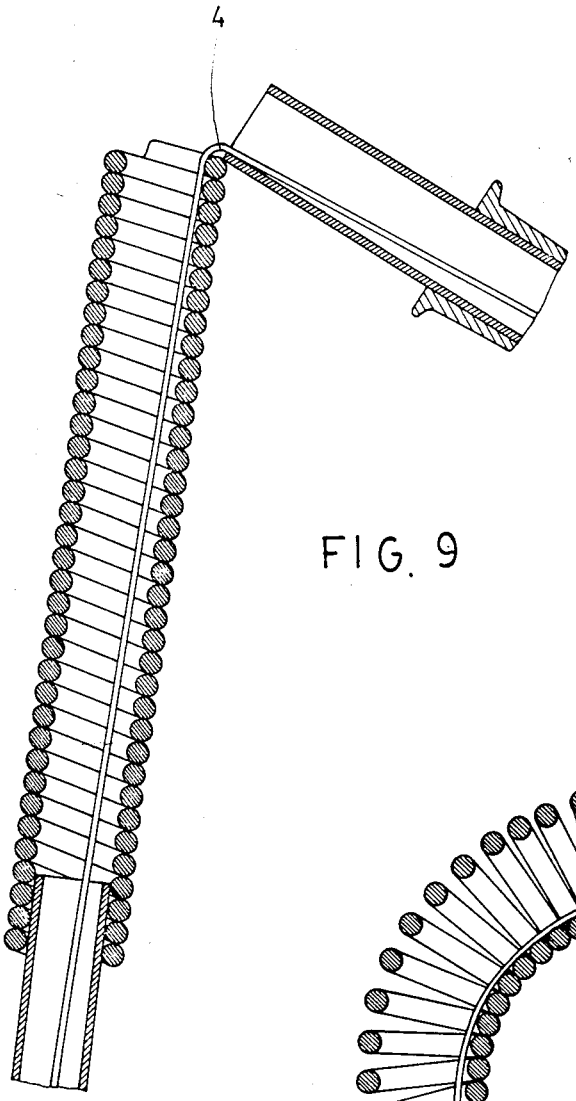
FIG. 9 is a sectional view of the unexpected breaking-loose condition between the steel spring coil and the handle pipe of the safety dyna-bender in FIG. 5 or 7

It will be appreciated that the material standard toughness of the center cord 4 installed in the structure of the safety dyna-bender according to this invention is that it will neither affect the bending operation during exercise nor can be caused to break in case of an unexpected breaking of the steel spring coil as shown in FIG. 8, or the accidental breaking loose of the handle pipe as shown in FIG. 9.

Figure 10:
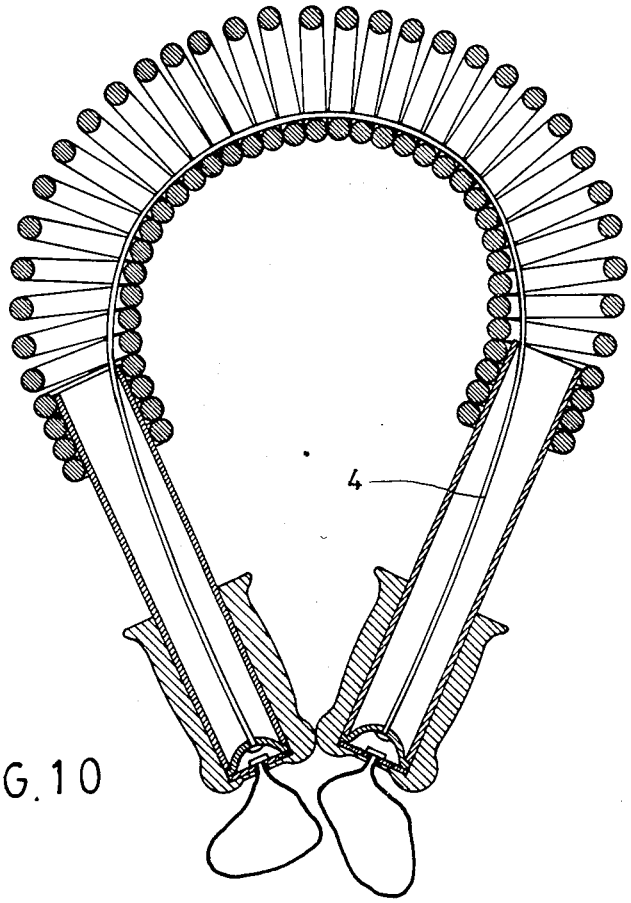
FIG. 10 is a sectional view of the preferred embodiment of FIG. 5 or 7 indicating the maximum bending operation.

Referring to FIG. 10, the length of the center cord 4 should be such that it meets the maximum bending requirement without neither obstructing the bending exercise nor reducing the effect of protection. For example, supposing the minimum length of the center cord 4 is "L" for the same safety dyna-bender, if the length of the center cord 4 is shorter than "L", the bending operation of that dyna-bender will be more or less hindered therewith; if the length of the center cord 4 is longer than "L", in case of breaking of the steel spring coil 1 or the breaking loose of the handle pipe 2 or 3, the eruption range of the broken parts will be increased, and thereofore, the protective capability of the center cord 4 is decreased. In this connection, the proper length of the center cord 4 is preferably equal to or just a little longer than the minimum length "L" required for maximum bending operations.

It will also be appreciated that the preferred embodiment of this invention resides in the following characteristics:

(1) As shown in FIGS. 8 and 9, no matter what an unexpected condition causes the breaking of the steel spring coil 4 or the breaking loose of the handle pipe 2 or 3, the eruption as well as the reverberation of the broken parts will be restrained by the center cord 4 without imposing any danger on the user himself or on the others near by.

(2) As shown in FIGS. 6 and 7, the arrangement of the cup-shape positioning anchors 23 and 33 and the center cord 4 is made on the basis of the flexible nature of the center cord material so that the center cord 4 can either be movably coupled with the cup-shape positioning anchors 23 and 33 or fixedly secured thereat for effecting the protection without affecting the bending operations of the safety dyna-bender.

(3) As shown in FIG. 6, the arrangement of the cup-shape positioning anchors 23 and 33 performs a further function in restricting the retracting movement of the wrist rings 22 and 32 so as to prevent them from withdrawing into the hollow section of the handle pipes 2 and 3, and provide the user with more protection capability.

While preferred embodiments have been chosen to illustrate this invention, it will be understood by those skilled in the art that various changes and modifications can be made therein without departing from the spirit and scope of this invention as defined in the appended claims.

What I claim is:

1. A safety dyna-bender having a steel spring coil, a pair of metal handle pipes repsectively connected at both ends of the steel spring coil defining a hollow section therein, a pair of hollow hand grips separately coupled with the outer end portions of the handle pipes, and a wrist ring provided at each end of the hand grips, which comprises:

a flexible cord movably installed in the hollow section defined by the steel spring coil and the handle pipes and positioning means respectively disposed at each end of the handle pipes for movably anchoring and restraining said flexible cord so that protection against any unexpected accidents resulting from either the breaking of the steel spring coil or the sudden loosening of the handle pipe thereof can be effected therewith, said positioning means comprises a pair of cup shaped positioning anchors each having a flange collar integrally formed along the edge thereof for being extrudingly secured along the open edge of the handle pipes, and a central aperture formed through the middle thereof for movably anchoring said flexible cable and restraining the retraction of the wrist rings thereof.

* * * * *